United States Patent [19]

Neff et al.

[11] Patent Number: 4,997,400

[45] Date of Patent: Mar. 5, 1991

[54] METHOD OF ALIGNING AND GAPPING ARC LAMP ELECTRODES

[75] Inventors: Louis D. Neff, Mt. Sterling; Steven L. Meade, Lexington, both of Ky.

[73] Assignee: GTE Products Corporation, Danvers, Mass.

[21] Appl. No.: 432,719

[22] Filed: Nov. 6, 1989

[51] Int. Cl.[5] ..... H01J 9/18

[52] U.S. Cl. ..... 445/26; 445/33

[58] Field of Search ..... 445/26, 33

[56] References Cited

U.S. PATENT DOCUMENTS 3,904,908 9/1975 Wolfe et al. ..... 445/27

4,340,836 7/1982 Bergman et al. ..... 313/631

4,508,514 4/1985 English ..... 445/26

*Primary Examiner*—Kenneth J. Ramsey

*Attorney, Agent, or Firm*—William E. Meyer

[57] ABSTRACT

A method of aligning and gapping arc lamp electrodes is to form a single piece electrode preform with a number of breakable junctions formed therein. The single piece preform is then positioned in the lamp envelope and sealed in place. The central portion of the preform is then removed by causing the breakable junctions to give way. The central portion is then removed from the enclosed lamp cavity, and the lamp sealing is finished by known methods.

13 Claims, 5 Drawing Sheets

METHOD OF ALIGNING AND GAPPING ARC LAMP ELECTRODES

1. TECHNICAL FIELD

The invention relates to electric lamps and particularly to arc lamps. More particularly the invention is concerned with a method of aligning and gapping arc lamp electrodes during initial manufacture.

2. BACKGROUND ART

Commonly, the electrodes in double ended arc discharge lamps are positioned in opposite ends of a glass tube leaving a tip portions exposed. One end of the electrode is held fixed, and the opposite end of the tube fixed The tube is then heated and collapsed around each electrode root to hold and seal the electrodes in place. By melting and then pressing a portion of the intermediate envelope material the two fixed pieces retain a relative registration. In fact there may be some motion of the electrode in the melted glass, particularly in lamps having extended length seals. During release and subsequent cooling there may be further relative motion between the captured electrode and the envelope volume. The electrode and the envelope are then not correctly aligned. Since there are two such electrodes, there may be two such misaligning motions. The result is then a pair of electrodes that are either not coaxial, or do not have the expected gap separation. The misaligned, or misgapped electrodes cause the arc to be misplaced which then affects the lamp optics and lamp life. There is then a need to accurately position, and gap arc discharge electrodes.

In a similar fashion, each electrode is normally positioned axially by placing the electrode a proper extent within the envelope tube. Again, the electrode may not be positioned along the axis correctly, or the axial positioning may be lost during the sealing process. Change in the axial gap separating the electrodes alters the starting, and operation conditions of an arc lamp. The arc may then require more or less power, or run at a lower or higher temperature than anticipated. There is then a need to accurately gap arc lamp electrodes.

For side by side, parallel arc discharge electrodes, the electrode pair are normally held in a vise like grip while the envelope is sealed around the electrode roots. The electrode tips, being loose ends, may be spread apart, or drawn together by the sealing process. Similarly, the electrodes may be mispositioned during the either the set up or the sealing steps. There is then a corresponding need to accurately align and gap parallel positioned arc lamp electrodes.

Examples of the prior methods of sealing discharge electrodes may be seen in U.S. Pat. No. 4,376,906 issued Mar. 15, 1983 to Imre Szilagyi, and in A New Low Wattage Metal Halide Lamp Process, Journal of the Illuminating Engineering Society, Fall 1985, page 109.

DISCLOSURE OF THE INVENTION

The electrodes of an arc discharge lamp may be aligned and gapped by forming a single piece electrode preform having a first electrode end, an intermediate section and a second electrode end. The first electrode end and second electrode end are each designed to have root sections and tip sections, there being breakable junctions formed between the first electrode tip and the intermediate section and the intermediate section and the second electrode tip. The electrode preform is positioned in a lamp envelope preform. The root portions of the electrode preform are sealed to the lamp envelope preform. The electrode tips are then accurately positioned by the coupling made by the intermediate section. Mechanical force or other force means are used to cause the intermediate section to separate from the first electrode tip and second electrode tip at the breakable junctions. The separated intermediate section is then removed from the lamp envelope. Completion of the lamp filling, and closure of the lamp are then carried out by ordinary means.

BEST MODE FOR CARRYING OUT THE INVENTION

Figure 1:
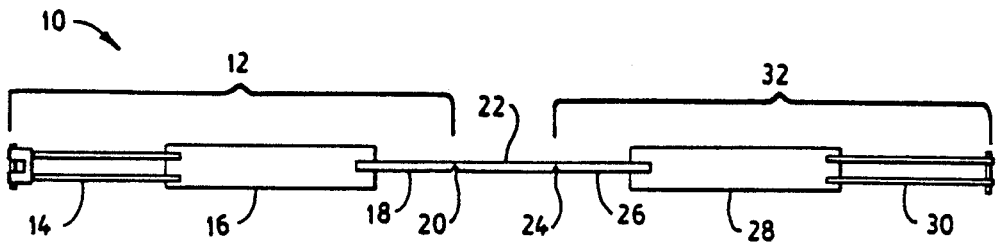
FIGS. 1 to 7 show alternative embodiments of electrode preforms.

The first step leading to proper electrode positioning is to form an electrode preform. FIG. 1 shows an embodiment of an electrode preform. The preform comprises a single piece electrode 10 having a first electrode end 12, an intermediate section 22, and a second electrode end 32. The first electrode end 12 has the form of an electrode as designed for final lamp operation. Typical arc discharge electrodes include a root portion having one or more leads 14, coupled to a sealing foil 16 which in turn is coupled to an first electrode tip 18. The correct, final positioning of the electrode tip 18 is an objective of the present method. The foil 16 may be replaced by a single rod, or rods of varying dimension depending on the seal method chosen, as is known in the art. The first electrode tip 18 may be a straight rod, or may also include coils, bends, hooks, or other features as are known in the art, all of which may be accommodated within the scope of the present method.

Coupled to any convenient point of the first electrode tip 18 is an intermediate section or bridge 22. The bridge 22 is used to apply positioning forces to the first electrode tip 18, and thereby assist in locating the first electrode tip 18. The preferred coupling is between the inner most, or active end of the tip 18 and the bridge 22. The coupling between the first electrode 12 and the bridge 22 should be a breakable junction 20 allowing the first electrode tip 18 to be separated from the bridge 22. The electrode tip 18 may be materially extended as a continuous piece through a narrowing or weakening of its material to the bridge 22. The thinned junction subsequently may be broken by mechanical or electrically force without damage to the lamp seal or electrode tips.

Opposite the first breakable junction 20 of the bridge 22 is a second breakable junction 24 leading to a second electrode tip 26, foil 28, and leads 30 all forming a second electrode end 32. The second electrode end 32 has the form of a second electrode as designed for final lamp operation. It is anticipated that in most instances the first electrode tip 18 and second electrode end 32 will be nearly if not exactly identical. In general the first electrode tip 18 and second electrode end 32 are formed as they would normally be formed with the electrode tips 18, 26 facing. The onlY exception is a breakable junction made with each electrode end 12, 32 to the bridge 22.

In the preferred embodiment, the first electrode tip 18 is materially extended through a narrowed diameter section forming the breakable junction 20 with the bridge 22. The bridge 22 may further include additional weakened or breakable points 34, such as intermediate thin sections, fracturable sections, or electrically breakable junctions 34. The intermediate breakable junctions 34 allow the bridge 22 to be broken down more easily.

The bridge 22 may take any convenient size or shape, but serves to hold the first electrode tip 18 and second electrode tip 26 apart at the correct electrode gap distance. The bridge 22 to the degree it is axially rigid with respect to the electrode ends 12, 32, further serves to hold the first electrode tip 18 and second electrode tip 26 in proper axial alignment. While it is possible to form the bridge 22 from a separate piece of perhaps a differing material such as glass rod or glass tubing, and couple the electrode tips 18, 26 to the bridge 22 forming an assemble, the preferred method is to form at least the first electrode tip 18, the bridge 22, and second electrode tip 26 as a group from a single piece of material. A straight rod section is the preferred form for the bridge 22. FIG. 1 shows a single piece electrode preform having a first electrode tip 18, bridge 22 and second electrode tip 26 with two narrowed rod sections forming breakable junctions. Two breakable junctions are thought to be the least number still providing a functional arrangement.

Figure 2:
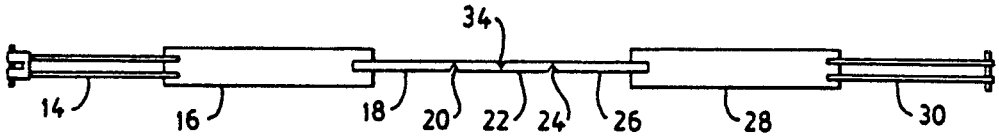

The preferred embodiment of the bridge 22 further includes one or more additional flexible or breakable junctions allowing the bridge 22 to be bend or break into subsections. The inclusion of bendable or breakable junctions in the bridge 22 lets the bridge 22 be reduced to two or more separate free ends that are easily broken from the electrode ends. FIG. 2 shows a single piece electrode preform having a first electrode tip 18, bridge 22 and second electrode tip 26 with three narrowed rod sections 20, 24, 34 forming breakable junctions. The additional breakable or flexible junction in the bridge 22, allows the bridge 22 to be collapsed during removal, thereby letting the breakable junctions 20, 24 with the electrode tips 18, 26 to bend and break away more easily Alternatively, the first electrode tip 18 may be coupled to the bridge 22 by a fracturable material, such as glass. Mechanical force maY then be used to subsequently break the junction between the first electrode tip 18 and the bridge 22. In a further alternative, the first electrode tip 18 may be coupled to the bridge 22 by an electrically meltable or vaporizable material such a thin section of metal, and particularly a thin section having a higher electrical resistance than the electrode root. Electrical current may then be used to break the junction between the first electrode tip 18 and the bridge 22. Similarly, a junction may be formed between the electrode tips and bridge where the elements have significantly different thermal expansions. Application of heat or cold, for example respectively by focused laser or liquid nitrogen, may be used to cause the expansion stress to separate the electrode tips and bridge section.

While the simplest electrode design is a straight rod, more complex structures are known. In particular, bent, or hooked electrode ends may be used, coiled ends may be used, and beaded ends may be used. There are also electrode structures know in the art that are asymmetrical, for example where one electrode is larger, or specially shaped. Nothing here is felt to conflict with the application of the present method to complex or asymmetrical electrodes.

Figure 3:
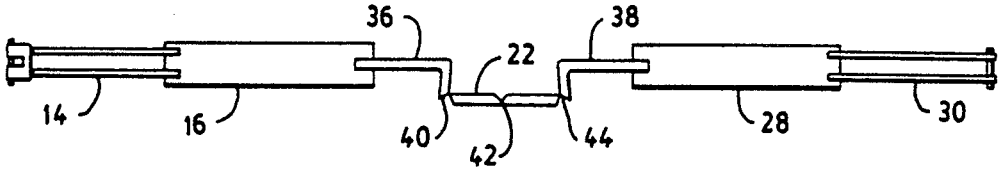
Figure 4:
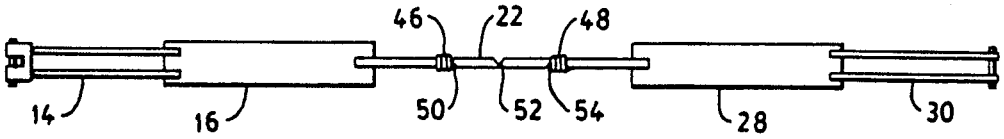

FIG. 3 shows a single piece electrode preform having a hooked first electrode tip 36, bridge 22 and hooked second electrode tip 38 with three narrowed rod sections 40, 42, 44 forming breakable junctions FIG. 4 shows a single piece electrode preform having a first electrode tip 46 with a coil type end bridge 22 and second electrode tip 48 with a coil type end and with three narrowed rod sections 50, 52, 54 forming breakable junctions.

Figure 5:
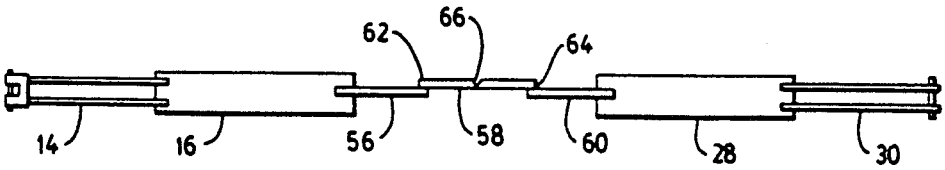

FIG. 5 shows a three piece electrode preform having a first electrode tip 56, bridge 58 and second electrode tip 60 coupled by two breakable welds 62, 64 for example poor welds, or thermally breakable welds or solderings, and an intermediate flexible cut 66. The bridge 58 is positioned along the sides of the electrode tips 56, 60 for convenient manufacture.

Figure 6:
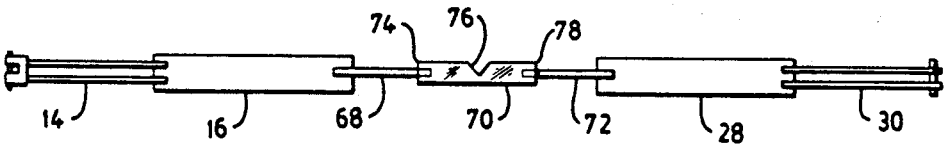

FIG. 6 shows a three piece electrode preform having a first electrode tip 68, bridge 70 made of a fracturable glass rod, an second electrode tip 72. The glass rod bridge 70 is heat fused to the electrode tips 68, 72 to from the two breakable junctions 74, 78. The glass rod is notched 76 to ease subsequent fracture, and removal.

Figure 7:
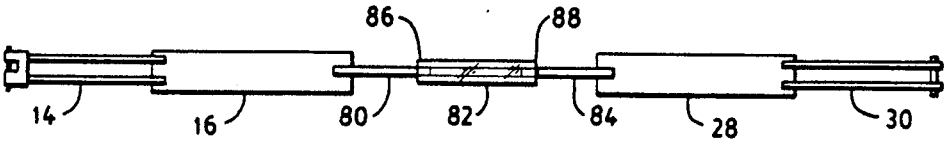

FIG. 7 shows a three piece electrode preform having a first electrode tip 80, bridge 82 made of glass tubing, and second electrode tip 84 coupled by two breakable junctions 86, 88. The electrode tips may be fused inside the glass tube, and the tube broken away later.

Figure 8:
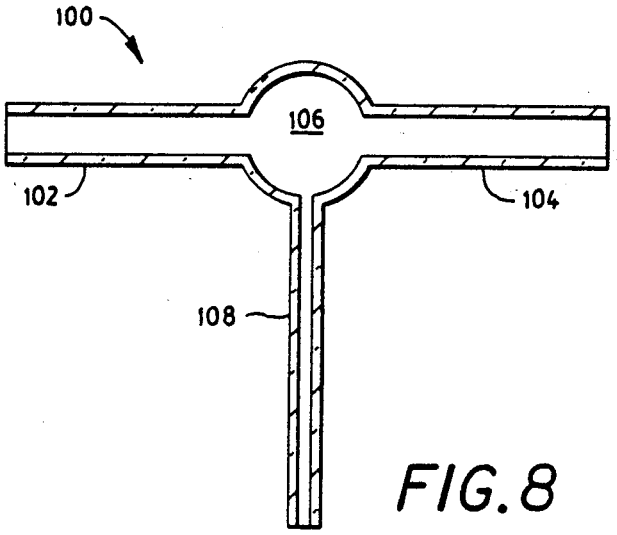
FIG. 8 shows a preferred lamp envelope preform.

FIG. 8 shows a preferred embodiment of a lamp envelope preform 100 made of glass or other light transmissive material for an arc discharge lamp. The lamp envelope preform 100 may have any convenient shape, but should have one or more passages to receive the electrode preform 10, so the electrode tips 18, 26 may be positioned in a lamp volume 106. The preferred envelope preform 100 shown in FIG. 8 is typical of double ended arc discharge lamps with a tubulation 108 passage. The envelope preform 100 is designed to enclose the first electrode root in a first passage 102, to enclose the second electrode in a second Passage 104, to enclose a lamP volume 106 for the electrode tips 18, 26, and bridge 22. The lamp envelope preform 100 should also have extending from the lamp volume 106 either a tubulation 108 formed prior to the final sealing of the lamp volume 106, or some other open passage into the enclosed volume 106. In the preferred embodiment, the tubulation 108 is formed before the electrode preform is positioned in the envelope preform 100. The tubulation 108 opening may also be formed later. The tubulation 108, is formed to allow removal of the bridge 22 and subsequent lamp filling. One variation is that the tubulation 108 preferably has a somewhat larger diameter than is typical of gas fill tubulations. The larger diameter tubulation 108 is convenient for contacting and removing the bridge 22.

Figure 9:
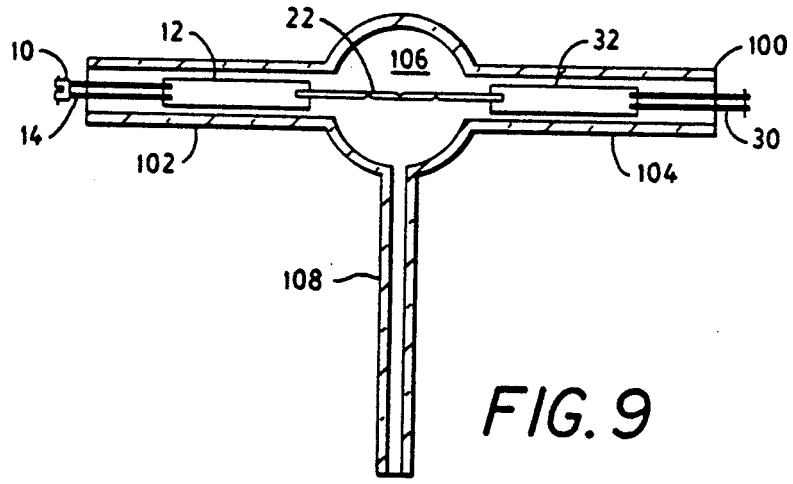
FIG. 9 shows a preferred electrode preform positioned in the preferred envelope preform.

The next step of the method of assembly is to position the electrode preform 10 in the envelope preform 100, so the first electrode end 12 is aligned in the first passage 102, the bridge 22 is positioned in the lamp volume 106, and the second electrode end 32 is aligned in the second passage 104. FIG. 9 shows the preferred electrode preform 10 positioned in the preferred envelope preform 100.

Figure 10:
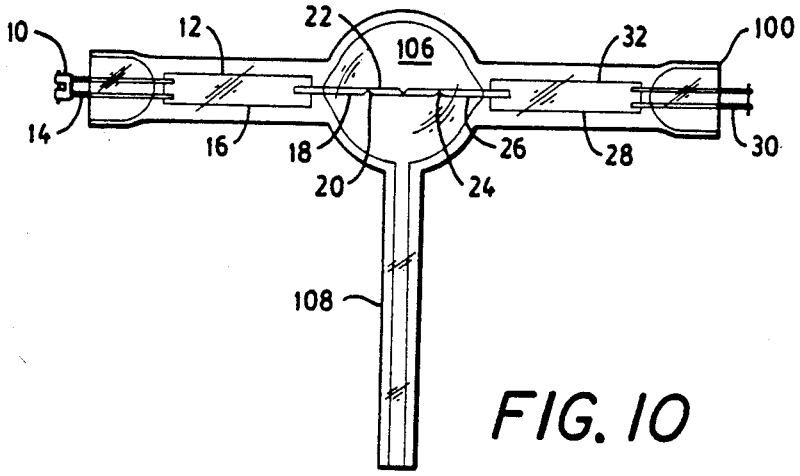
FIG. 10 shows an electrode preform sealed in an envelope preform.

The third step is to seal the electrode Preform 10 along the electrode ends 12, 32 to the adjacent envelope preform material. The preferred method of sealing is to heat the adjacent envelope preform 100 material to a softened state, and mechanically press the softened material to the electrode root areas, for example to seal with foils 16, 28 of the electrodes. Press sealing of electrodes with or without foil seals is generally known in the art and needs no expansion on here. Since the first electrode tip 18 and second electrode tip 26 are coupled by the bridge 22, the electrode tips 18, 26 tend to keep both their initial alignment, and gap separation. The seal is then allowed to set thereby preserving the established alignment and gap as set by the bridge 22. The electrode leads may be held fixed with respect to each other during the sealing. The present method is felt to include the oPtion of not holding the leads during the press sealing, since the bridge still acts to position the electrode tips. FIG. 10 shows the preferred electrode preform 10 sealed in the preferred envelope preform 100.

The partially completed lamp may now be processed through additional stages, one of which may be the addition to the lamp volume 106 of a tubulation 108 passage. The tubulation 108, whether formed prior to or after sealing, should Provide a sufficient opening to allow the release of the bridge 22, or the pieces the bridge 22 is reduced to during removal.

Figure 11:
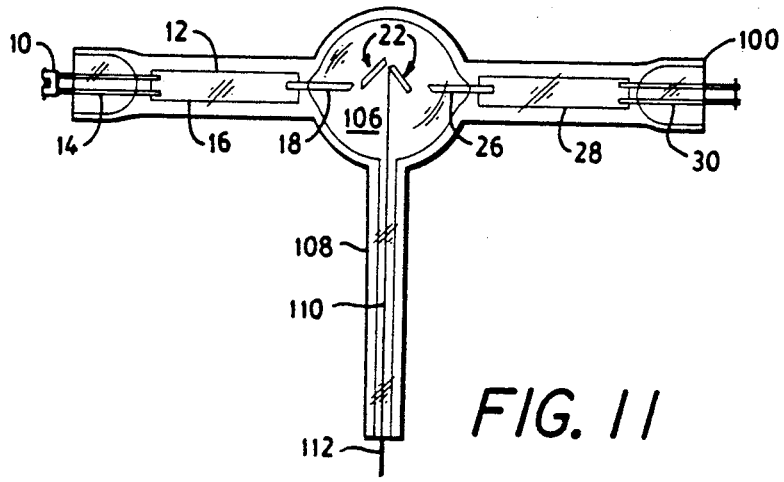
FIG. 11 shows the intermediate section of an electrode preform being broken away by a tool.

The next step is to cause the breakable junctions 20, 24 between the first electrode tip 18 and the bridge 22, and between the bridge 22 and the second electrode tip 26 to break away, thereby releasing the bridge 22. Once the electrode preform 10 is sealed in place, a tool 110 may be inserted through the tubulation 108 passage, or other oPen passage to contact the bridge 22. APplying force to the bridge 22 by the tool 110 causes the breakable junctions 20, and 24 to break. The first electrode tip 18, the bridge 22, and the second electrode tip 26 are then separated. The bridge 22 is then reduced to one or more free pieces inside the lamp lamp volume 106. The tool 110 is then removed from the tubulation 108. FIG. 11 shows a tool 110 applying force to the bridge 22 causing it to collapse and break away from the two electrode tips 18, 26.

In the alternative, depending on the nature of the formed breakable junctions, heat, cold, mechanical, or electrical means may be applied to the breakable junctions to open the junctions and release bridge section. For example, a current may be applied through the two electrode leads 14, 30 or between the leads 14, 30 and tool 110 causing thinned, meltable or vaporizable junction materials to give way. Again the bridge 22 is separated from the first electrode tip 18 and the second electrode tip 26. The bridge 22 is again reduced to one or more free pieces positioned in the lamp volume 106.

Figure 12:
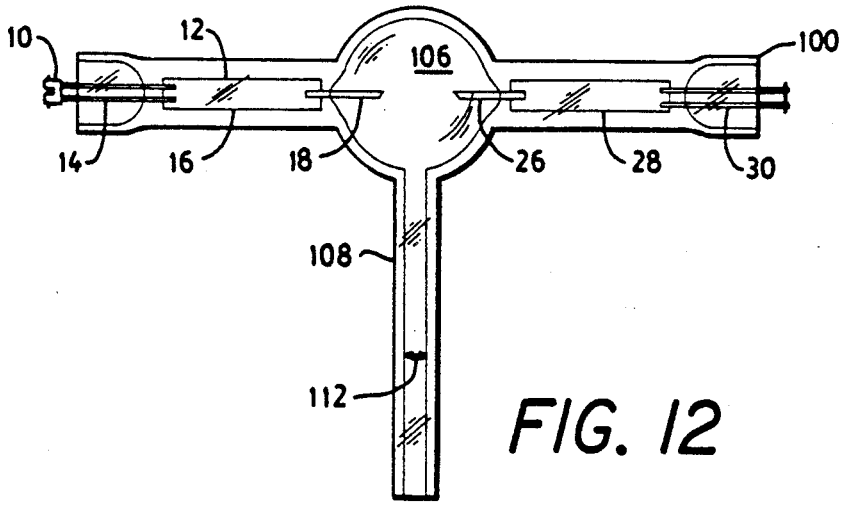
FIG. 12 shows a lamp with the tool and broken bridge elements removed.

The next step is to remove the now freed bridge 22 or bridge sections, as the case may be, from the lamp volume 106. If the tubulation 108 has a sufficiently large passage 112, the remains of the bridge 22 may be easily shaken or otherwise removed from the lamp volume 106. It has been found that where the lamp volume 106 includes arched sides, and the tubulation 108 has a reasonably large passage 112, the remains of the bridge 22 slide down the inside walls of the lamp envelope and fall from the lamp volume 106 under the force of gravity FIG. 12 shows the lamp with the bridge 22 and tool 110 removed.

Figure 13:
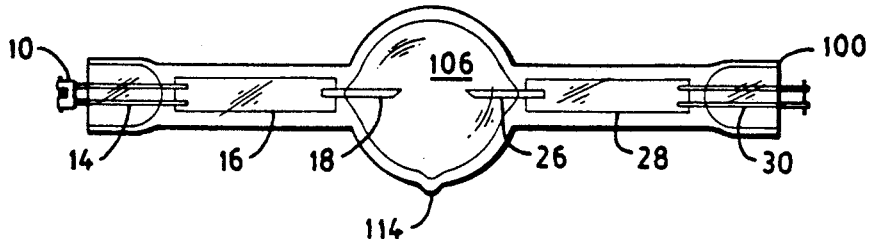
FIG. 13 shows a lamp closed after removing the intermediate bridge section.

The final step is to complete the closure of the lamp volume 106 as is generally understood bY those practiced in the art of lamp manufacture. The closure process may include adding fill materials such as mercury, fill gases and so on to the lamp volume 106 through the tubulation 108. The lamp envelope with the electrodes sealed in place is then usually cooled, and an appropriate fill gas added to the lamp volume 106. The tubulation 108 is then closed, normally by heating it to a softened state and tipping off. The lamp may be further sealed, cemented, mounted, soldered, electrically connected, or otherwise processed to finish the completed design according to appropriate procedures as known in the art. FIG. 13 shows the arc lamp after finishing and closing the tubulation 108 passage at a tip off 114.

Figure 14:
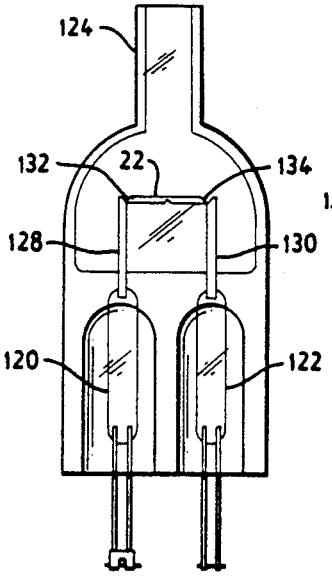
FIG. 14 shows an arc lamp with straight side by side electrodes and a coupling intermediate section.
Figure 16:
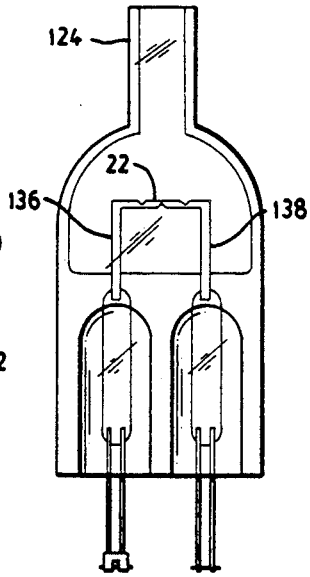
FIG. 16 shows an arc lamp with right angle shaped side by side electrodes and a coupling intermediate section.
Figure 18:
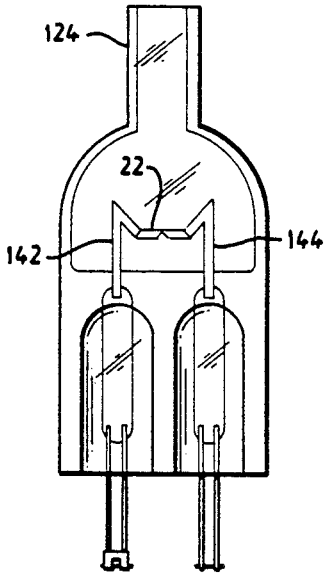
FIG. 18 shows an arc lamp with hooked side by side electrodes and a coupling intermediate section.
Figure 15:
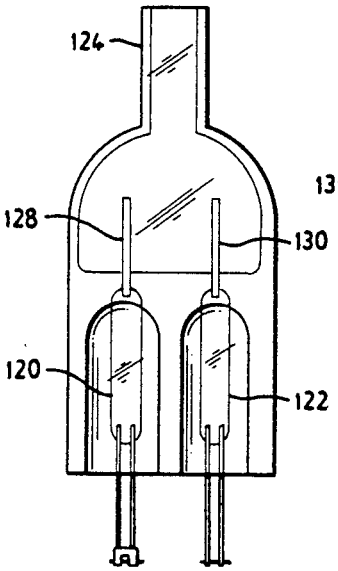
FIG. 15 shows the lamp of FIG. 14 after removing the intermediate section.
Figure 17:
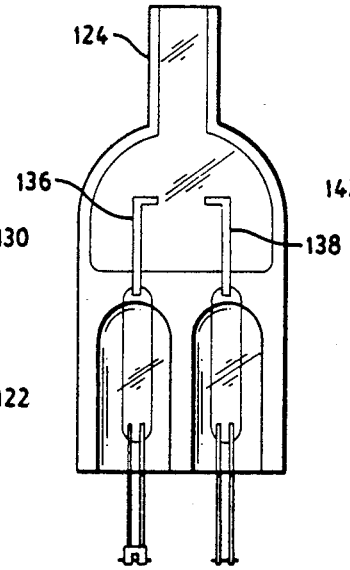
FIG. 17 shows the lamp of FIG. 16 after removing the intermediate section.
Figure 19:
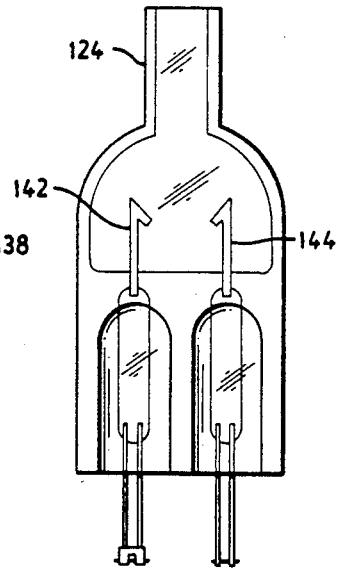
FIG. 19 shows the lamp of FIG. 18 after removing the intermediate section.

Parallel, or substantially side by side electrodes may also be aligned and gapped according to the present teaching. The electrode tips and bridge section may be formed generally in a U shape, with the sides of the U being the electrodes, and the base of the U being the bridge portion. FIG. 14 shows a pair of side by side electrodes 120, 122 sealed in a single ended arc discharge lamp envelope 124. A bridge 22 may connect the electrode tips 128, 130 with interposed breakable junctions 132, 134. Once the electrodes are sealed in the lamp, the bridge 22 may be broken away and removed, leaving the electrode tips 128, 130 properly gapped and aligned. FIG. 15 shows the corresponding single ended lamp after the bridge 22 has been removed FIG. 16 shows a variation wherein right angled (L shaped), side by side electrode tips 136, 138 may be used with the break away bridge 22. FIG. 17 shows the corresponding single ended lamp after the intermediate section has been removed. Similarly, FIG. 18 shows hooked, side by side electrodes 142, 144 with a removable bridge 22. FIG. 19 shows the corresponding single ended lamp after the intermediate section has been removed.

In a working example, a solid tungsten rod was used as the first electrode, bridge, and second electrode of an electrode preform. The rod was welded to molybdenum sealing ribbons, which were in turn connected to lamp leads. The tungsten rod was scored in three places until it was a few thousands of an inch thick. An envelope preform was made to accept the electrode preform. The bulb portion was not necked down to allow passage of the electrode preform. An oversized exhaust tube was used to tubulate the bulb. The legs of the envelope preform were press sealed to the molybdenum ribbon seals. A tungsten rod was inserted through the exhaust tube to press against the bridge portion of the tungsten rod until the two bridge pieces of the tungsten rod broke away, leaving the sealed rod ends to serve as electrodes. An accurate and consistent arc gap was thereby formed between the electrode ends. While there have been shown and described what are at present considered to be the preferred embodiments of the invention, it will be apparent to those skilled in the art that various changes and modifications can be made herein without departing from the scope of the invention defined by the appended claims.

What is claimed is:

1. A method of gapping arc lamp electrodes comprising the steps of:

(a) forming an electrode preform having a first electrode end, a bridge and a second electrode end, the first electrode end and second electrode end each having root sections and tip sections, there being breakable junctions formed between the first electrode tip and the bridge and between the bridge and the second electrode tip, (b) positioning the electrode preform in a lamp envelope, (c) sealing the root sections of the electrode preform to the lamp envelope, and (d) causing the bridge of the electrode preform to separate from the first electrode tip and second electrode tip at the breakable junctions.

2. A method of gapping arc lamp electrodes comprising the steps of:

(a) forming an electrode preform having a first electrode end, a bridge and a second electrode end, the first electrode end and second electrode end each having lead ends, root sections and tip sections, there being breakable junctions formed between the first electrode tip and the bridge and between the bridge and the second electrode tip, (b) positioning the electrode preform in a lamp envelope, (c) holding the electrode leads ends fixed with respect to each other, (d) sealing the root sections of the electrode preform to the lamp envelope, and (e) causing the bridge of the electrode preform to separate from the first electrode tip and second electrode tip at the breakable junctions.

3. A method of forming an arc lamp with accurately gapped electrodes comprising the steps of:

(a) forming an electrode preform having a first electrode end, a bridge and a second electrode end, the first electrode end and second electrode end each having root sections and tip sections, there being breakable junctions formed between the first electrode tip and the bridge and between the bridge and the second electrode tip, (b) positioning the electrode preform in a lamp envelope, (c) sealing the root sections of the electrode preform to the lamp envelope, (d) causing the bridge of the electrode preform to separate from the first electrode tip and second electrode tip at the breakable junctions, (e) removing the separated bridge from the lamp envelope, and (f) completing the lamp fill and closure.

4. A method of aligning and gapping arc lamp electrodes comprising the steps of:

(a) forming an electrode preform having a first electrode end, a bridge and a second electrode end, each of the first and second electrode ends having root sections and tip sections, there being breakable junctions formed between the first electrode tip and the bridge and the intermediate sections and the second electrode tip, (b) positioning the electrode preform in a lamp envelope, (c) sealing the electrode preform to the lamp envelope, (d) contacting the electrode preform with the tool through a passage in the lamp envelope to cause a central portion of the electrode preform to breakaway from the respective first and second electrode ends at the breakable junctions, (e) removing the tool, (f) removing the central preform material from the lamp envelope, and (g) completing the lamp fill and closure.

5. The method in claim 1, wherein the lamp envelope is a double ended envelope and the electrode preform has two opposed ends.

6. The method in claim 1, wherein the lamp envelope is a single ended envelope and the electrode preform has two side by side ends.

7. The method in claim 1, wherein the preform includes three breakable junctions.

8. The method in claim 1, wherein the method of causing the first electrode tip to separate from the bridge includes mechanical force applied to the bridge.

9. The method in claim 1, wherein the method of causing the first electrode tip to separate from the bridge includes electrical current apPlied between the first electrode tip and the bridge.

10. The method in claim 1, wherein the method of causing the first electrode tip to separate from the bridge includes heat applied between the first electrode tip and the bridge.

11. The method in claim 1, wherein the method of causing the first electrode tip to separate from the bridge includes cold applied between the first electrode tip and the bridge.

12. A method of aligning and gapping arc lamp electrodes comprising the steps of:

(a) forming an electrode preform having a first electrode end, a bridge and a second electrode end, each of the first and second electrode ends having root sections and tip sections, there being breakable junctions formed between the first electrode tip and the bridge and the bridges and the second electrode tip, (b) positioning the electrode preform in a lamp envelope, (c) sealing the electrode preform to the lamp envelope, and (d) contacting the electrode preform with the tool through a passage in the lamp envelope to cause a central portion of the electrode preform to breakaway from the respective first and second electrode ends at the breakable junctions.

13. A method of forming an arc lamp having properly gapped electrodes comprising the steps of:

(a) forming an electrode preform having a first electrode end, a bridge and a second electrode end, each of the first and second electrode ends having lead sections, root sections and tip sections, there being breakable junctions formed between the first electrode tip and the bridge and the bridges and the second electrode tip, (b) positioning the electrode preform in a lamp envelope, (c) holding the electrode leads ends fixed with respect to each other, (d) sealing the electrode preform to the lamp envelope, (e) contacting the electrode preform with the tool through a passage in the lamp envelope to cause a central portion of the electrode preform to breakaway from the respective first and second electrode ends at the breakable junctions, (f) removing the tool, (g) removing the central preform material from the lamp envelope, and (h) completing the lamp closure.

* * * * *